US006463679B1

(12) United States Patent
Buttigieg

(10) Patent No.: US 6,463,679 B1
(45) Date of Patent: Oct. 15, 2002

(54) FORCED VENTILATION SYSTEM INSIDE SOLES

(75) Inventor: Carmel Buttigieg, Triq Il-Ferrovija Santa Venera (MT)

(73) Assignee: Yamamoto Limited, Valletta (MT)

( * ) Notice: Subject to any disclaimer, the term of this patent is extended or adjusted under 35 U.S.C. 154(b) by 0 days.

(21) Appl. No.: 09/685,121

(22) Filed: Oct. 10, 2000

(30) Foreign Application Priority Data

Oct. 21, 1999 (MT) ..... 1399

(51) Int. Cl.[7] ..... A43B 7/08; A43B 13/20
(52) U.S. Cl. ..... 36/3 B; 36/29
(58) Field of Search ..... 36/3 B, 3 R, 29

(56) References Cited

U.S. PATENT DOCUMENTS 3,060,599 A * 10/1962 Okuyama
3,335,505 A * 8/1967 Stec
4,071,963 A * 2/1978 Fukuoka
4,674,203 A * 6/1987 Goller
5,068,981 A * 12/1991 Jung
5,341,581 A * 8/1994 Huang
5,353,525 A * 10/1994 Grim
5,477,626 A * 12/1995 Kwon
5,505,010 A * 4/1996 Fukuoka
5,515,622 A * 5/1996 Lee
5,655,314 A * 8/1997 Petracci
5,826,349 A * 10/1998 Goss
5,974,694 A * 11/1999 Vecchiola
5,996,250 A * 12/1999 Reed et al.
6,041,519 A * 3/2000 Cheng

* cited by examiner

*Primary Examiner*—Ted Kavanaugh
(74) *Attorney, Agent, or Firm*—Bucknam and Archer

(57) ABSTRACT

This forced ventilation system is composed basically by a plastic box located in the rear part of the sole connected with a flow-conveyor through one or more tubes joined to one or more pneumatic valves.

Its essential role is founded on the principle that its compression every step generates a forced ventilation internally the sole and consequently internally the shoe.

This system can be closed by a special cap, excluding this process.

7 Claims, 6 Drawing Sheets

FORCED VENTILATION SYSTEM INSIDE SOLES

FIELD OF THE INVENTION

The present invention relates to a forced ventilation system inside shoe sales and, more particularly, it relates to such a system including a pump inside the shoe sole activated by a walking or running activity.

DESCRIPTION OF THE PRIOR ART

Those who are involved in the shoe industry, and particularly the sport shoe industry, have the basic aim of cushioning and air circulation inside the shoe. The most important factor involved in all designs for this purpose is that generally the air suction is accomplished through pneumatic devices, generally called "pumps", formed of plastic or rubber, located in the heel area, but which do not have the necessary force for an instanteous recovery effect following each step and, at the present state of the art, do not provide for any flow conveyor capable of storing and directing the air of this area to the pump and the possibility of closing the system.

There are two possibilities of air circulation: one is to suck in outside air and inject it internally to the sole and the other is to suck the air internally in the sole and to discharge it outside. In the present description only this second situation is described because it is the more important.

In known systems, the pump, the real engine of the system, as shown in FIG. 1, generally is a bladder (1) produced by soldering or welding the edges (2 and 3) of two plastic shells, separately produced by the process of injection molding. From a hole of this bladder a tube (4) emerges. The tube, which can be formed by two half tubes (4*a* and 4*b*) soldered or welded together, has two arms (5 and 6). Arm (5) is directed toward the external edge of the sole, while arm (6) is joined to a pneumatic valve (8) which sucks air internally of the sole.

Such air circulation systems have the following drawbacks. With respect to the pumping device, bladder (1) generally has a low reactivity as a result of its construction, because of its shape and because of the material used. For these reasons it does not make the full suction within the 200 milliseconds between two steps and therefore it is only partially effective. Also, bladder (1) can not suck humidity and bad smells and its soldering may be the cause of breaking.

SUMMARY OF THE INVENTION

The system of the present invention contemplates two kinds of reactive pumping devices which instantaneously put in motion the whole system with a very strong force.

As seen in the system according to FIG. 1, the tube (6), joined to the valve (8), sucks in a random way and only in a small area (9) where there is provided no device to store and to discharge air, humidity and smells. Therefore the consequent suction is very limited.

In the system according to the present invention, a flow conveyor in the plantar area stores and conveys the air, humidity and smell through pneumatic valves joined to tubes and connected to the pump which discharges the air, humidity and smell to the outside through a pneumatic valve.

Also, the prior art systems do not provide for closing. This fact can be a problem especially at night, because, evidently each step produces a little blowing, and furthermore it is totally useless if the user wears these shoes at very low air temperature. This problem can be voided using, according to the present invention, a closing which can exclude the whole system when the user does not need it. When the system is closed, the pumping device becomes a very reactive element, being completely full of air, giving the heel area of the sole a special cushioning effect.

BRIEF DESCRIPTION OF THE DRAWINGS

The features of the present invention will be apparent from the following detailed description considered in connection with the accompanying drawings, in which.

DETAILED DESCRIPTION OF THE INVENTION

This invention relates to a new technology for air circulation inside shoe soles formed by four essential elements: a pump connected through one or more tubes to one or more pneumatic valves, joined to a flow conveyor, and the whole system can be excluded using a special cap which closes the external valve.

In order to give the system a special suction force, the pump can be produced without reactive elements inside or with reactive elements. FIG. 2 shows a pump without reactive elements inside. The plastic pump device is produced according to the technology of rotational molding, the only process which allows the pump's shape as here described, and using thermoplastic resins with a high elastic modulus. With this technology the soldering or welding of two shells is avoided and this pump will be produced in a single body with the consequence that, during its continuous work, it will not have the possibility of breaking. The pump is formed in three parts or sections. The upper part (10) is dome-shaped, and located over the line (x—x) which corresponds to the inner surface of the sole when in direct contact with the user's heel. It is that part in motion which generates the air flow. The medial part of the pump (11), between the section x—x and y—y, is located in the medial part of the sole and whose role is to be the tank of the air which will be moved, it has the same elasticity as that of the upper part. The lower part (12) is located in the lower part of the sole and here all the tubular connections are made. This part has no elasticity since it is formed of a solid structure.

Figure 1A:
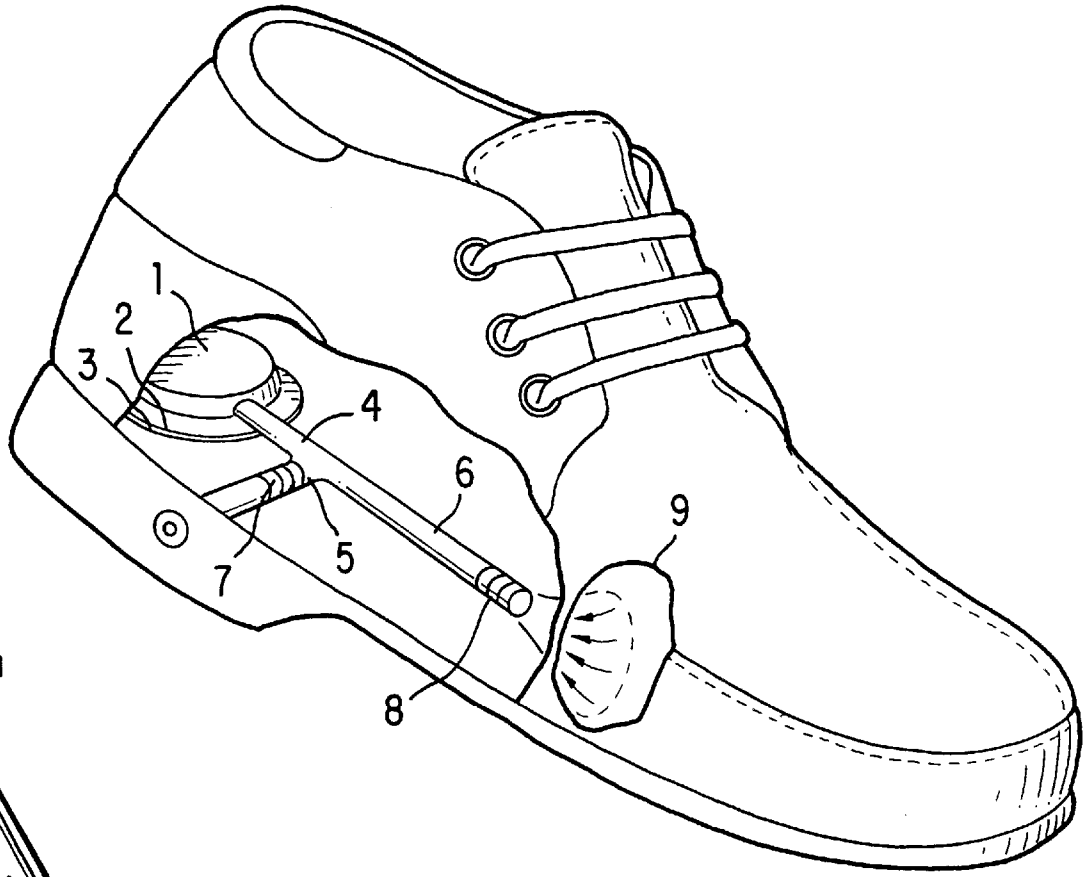
FIG. 1A PRIOR ART
FIG. 1A is a perspective partial broken away view of a shoe housing a prior art bladder pump.
Figure 1B:
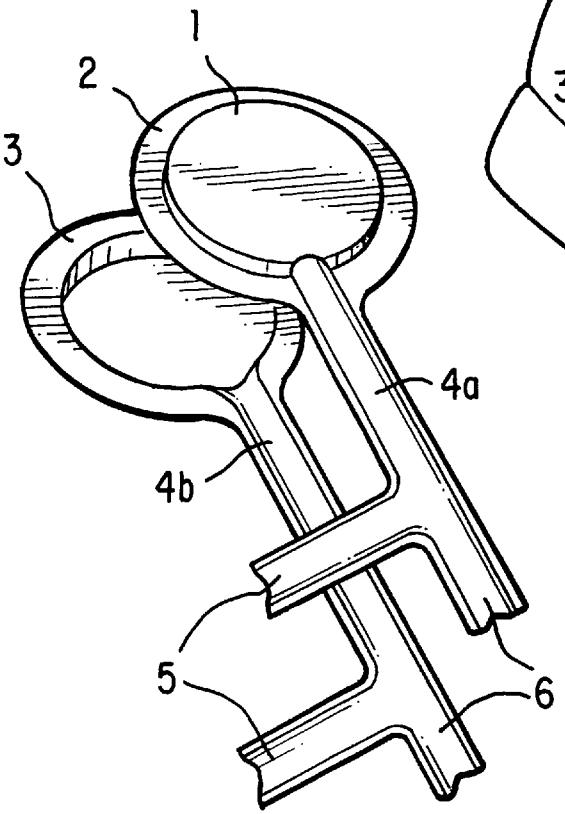
FIG. 1B PRIOR ART
FIG. 1B is a perspective exploded view of the prior art bladder pump of FIG. 1A.
Figure 2B:
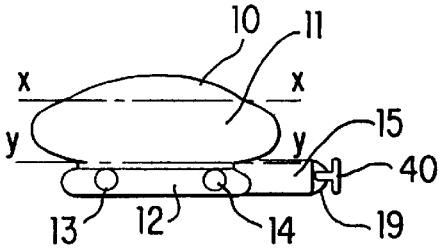
FIGS. 2B–2C are side views of the pump of the system of the present invention in operation.
Figure 2C:
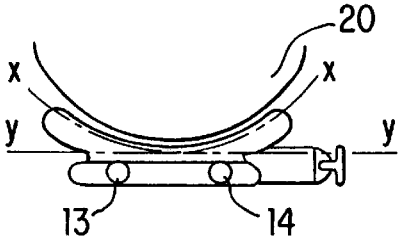
Figure 2D:
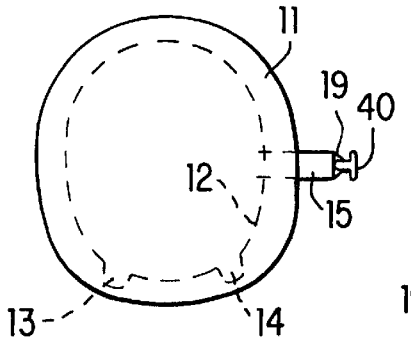
FIG. 2D is a plan view of the pump of the system of the present invention.

In FIG. 2B the pump is in its natural or normal uncompressed position. In FIG. 2C the pump is compressed by the heel (20) and therefore the upper part (10) enters the medial part (11) bringing the axis x—x into contact with the axis y—y forming a mechanical structure like a leaf spring and therefore very reactive with the consequence that, once the heel leaves the upper part, the medial part reacts to return immediately to its natural or normal position. During this movement, the air contained in the pump is moved inside and outside the sole.

As indicated above, in lower part (12) of the pump the tubular connections are pre-formed. One or more connections (13, 14), directed to the inner part of the sole, emerge from part (12) and into these connections one or more tubes (17, 18) are inserted, with a different length in order to reach different zones of the sole. Into these tubes pneumatic valves (19) are inserted. Alternatively, these valves can be inserted directly into the connections (13, 14) and the tubes (17, 18) connected with them. On a lateral side of lower part (12) a single connection (15) emerges and is directly joined with a pneumatic valve (19). These valves can operate to discharge air or by inverting their position, to suck air.

Figure 5A:
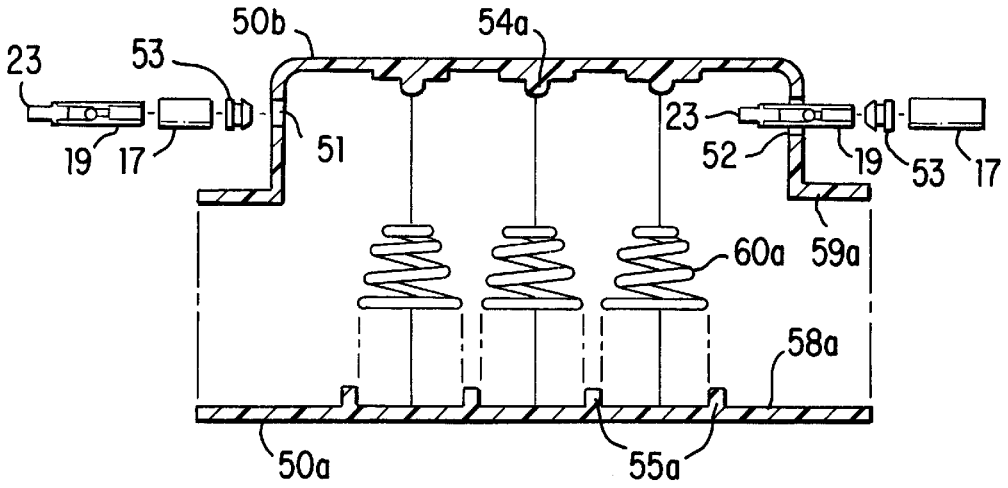
FIG. 5A shows a pump having spring reactive elements for use in the present system.
Figure 5B:
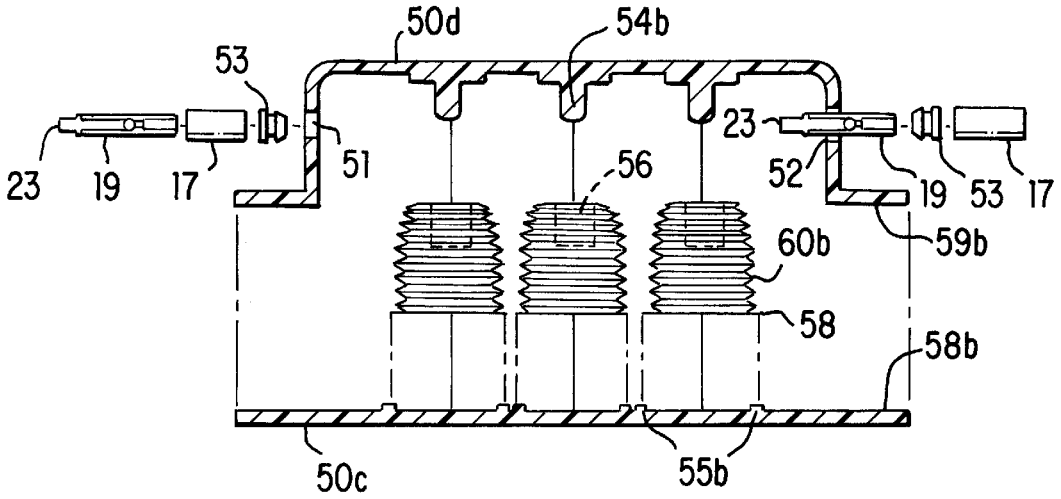
FIG. 5B shows a pump having bellows reactive elements for use in the present system.
Figure 5C:
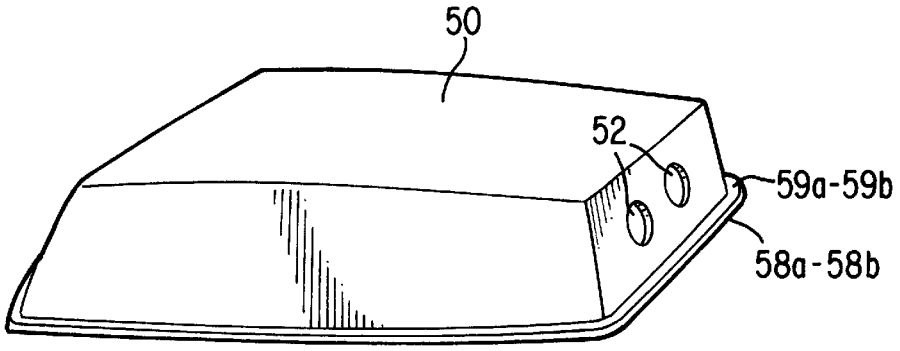
FIG. 5C is a perspective view of the plastic box housing for the reactive elements shown in FIGS. 5A and 5B.

An important recovery effect can be obtained using a special plastic box which incorporates reactive elements which give the pump a real and immediate recovery effect. These reactive elements, as shown in FIGS. 5A and 5B can be one or more springs (60*a*) or one or more bellows (60*b*).

The application of springs to a plastic device generally are based on the principle that two pins hold the spring in the correct position. One pin enters the top or upper coil and one enters the bottom or lower coil. Inserting these boxes into the heel area of a sole, it was found that it is impossible to hold a metal spring with the two plastic pins because a shoe's sole is a dynamic element, which must support three dimensional movements with the consequence that the strength of the metal spring overcomes the strength of the plastic of the pin, resulting in breaking of the system.

The present invention solves this problem relating to how metal springs can be fixed in the proper way into a plastic system. First, the spring (60*a*) must have two or more coils, its best shape is a conical one. The upper coil enters the fixing pin (54*a*) pre-formed on the inner surface of the plastic cover (50*b*). In order to avoid any movement of the spring, the lower coil is fixed into the ring (55*a*) pre-formed on the inner surface of the lower plate (50*a*). This fixing must be as tight as possible and is accomplished by using a transformer, which steps down the common voltage to a low voltage and by connecting its positive and negative poles with two thin copper plates. If the lower coil of spring (60*a*) is put in contact with these two thin plates, a short circuit is generated and as a result of the Joule effect this coil of the spring becomes incandescent and is immediately inserted into the ring (55*a*), amalgamating the metal of the heated coil with plastic. In this way a perfect fixing is guaranteed which will avoid any movement. The use of electricity with a transformer for this purpose allows a modular administration of the heating given the lower coil of the spring, avoiding the transfer of heat to other coils of the spring so that they do not lose their hardening.

The use of the plastic bellows (60*b*) is an up-to-date fact due to the new technopolymers with high elastic modulus, such as thermoplastic polyester elastomers, which confer on the bellows a fast recovery like a metal spring. These bellows are produced with theprocess of rotational molding or blow molding. These plastic bellows (60*b*), as shown in FIG. 5B, are formed with two or more convolutions. The upper convolution has a hole (56) which has a larger diameter than the diameter of the corresponding pin (54*b*) pre-formed on the inner surface of the plastic cover (50*d*). The lower convolution has a reinforced base (58) with the same diameter as the corresponding pin (55*b*) preformed on the inner surface of the plastic plate (50*c*). Base (58) is soldered or welded with plate (50*c*) by means of high-frequency or ultra-sound. Both these processes can guarantee a perfect soldering or welding around the whole perimeter of the base of the bellows.

Since these bellows are soldered to lower plate (50*c*) and firmly joined to upper cover (50*d*) and produced with a plastic material having high elastic modulus, they will perform similarly to a spring.

Once these reactive elements, springs or bellows, are inserted into the plastic box, the box will be closed by the soldering of its external edges: 50*a* with 50*b* in FIG. 5A and 50*c* with 50*d* in FIG. 5B. The plastic box so composed will have in the rear or external part of the plastic cover one or more holes (51), where one or more plastic gaskets (53) will be inserted. Into these gaskets (53) one or more tubes (17) will be joined and then one or more pneumatic valves (19) will be joined to the tubes (17). These valves must be positioned with their head (23) externally. At the front of the box the system will be composed of one or more holes (52) where the consequent valves (19) enter through gaskets (53) into which tubes (17) are joined. These valves must be positioned with their head (23) internally.

These described valves function opposite to one another. When one is open the other is closed and by inverting the sense of the valves the sense of air flow will be inverted also, from discharging the air outside the sole to sucking the air inside it. As mentioned above, in this description only the case of discharging air outside the sole is discussed.

Figure 3A:
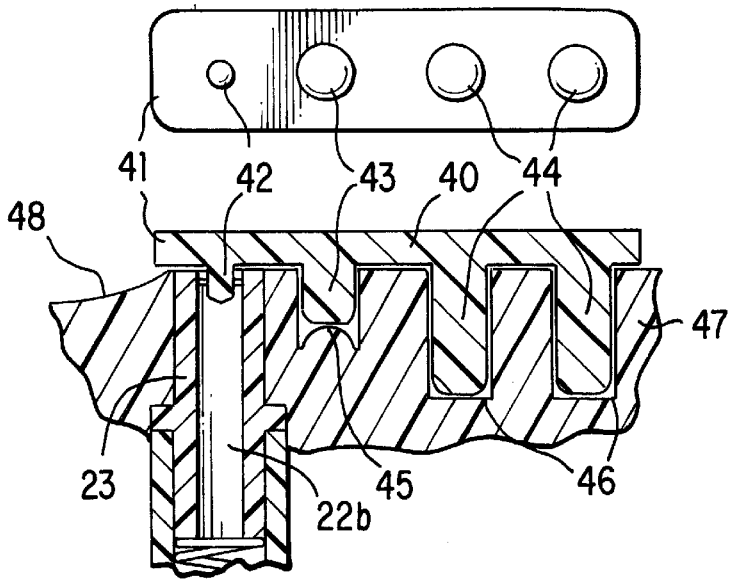
FIGS. 3A–3B are cross-sectional views of the pneumatic valve of the present system and a closing device therefor.
Figure 3B:
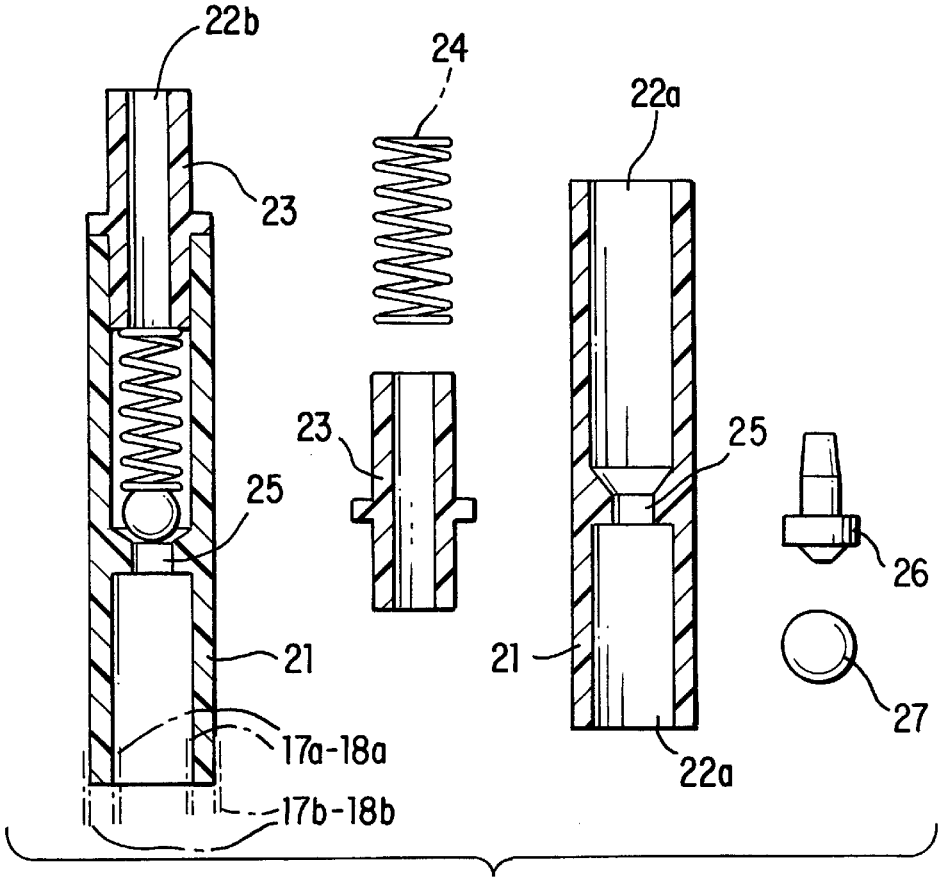

In FIG. 3 the essential elements of the valve are shown. Basically it is composed of a tube (21) into which two essential components are placed, a piston (26) or a sphere (27) adapted to close the inner hole (25) of tube (21), and a spring (24) which biases the piston or sphere in the proper closing position. When these components are inserted, they are held in position by the cap (23) which has an internal hole (22*b*) smaller than hole (22*a*) of tube (21). On the opposite side the valve has the hole (22*a*) into which the tube (17 or 18) enters. This tube may enter the tube (21) of the valve internally (17*a*–18*a*) or externally (17*b*–18*b*).

Figure 2A:
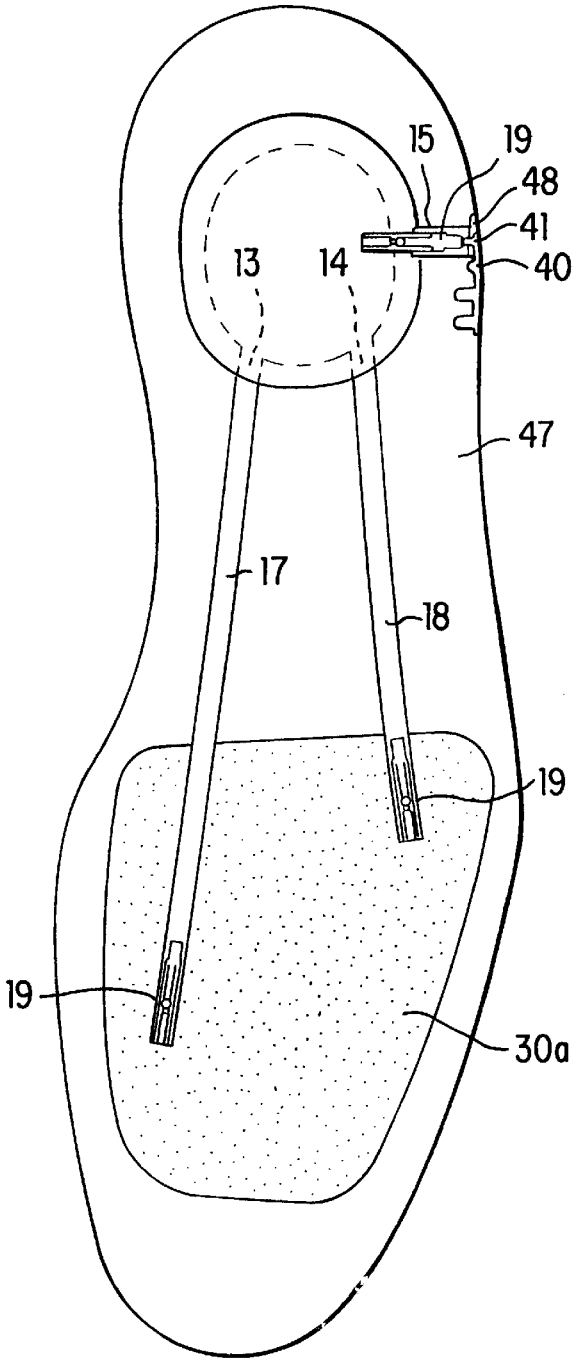
FIG. 2A is a plan view of a shoe with the system of the present invention.
Figure 4B:
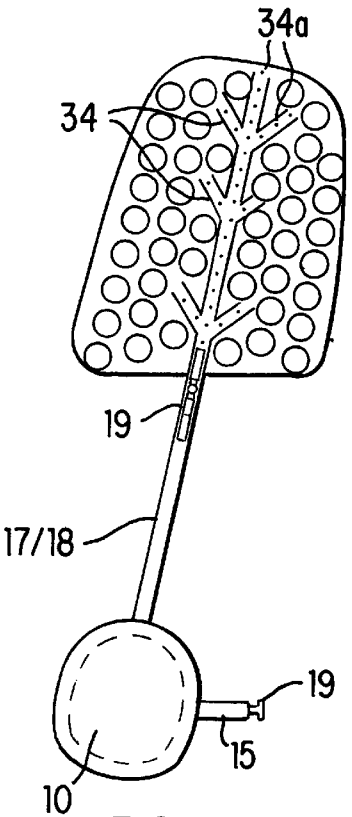
FIGS. 4A–4D show the flow conveyor of the present system.

In order to suck a greater quantity of air, humidity and smell from the plantar side of the sole, valves (19) or the tubes (17 or 18) will be placed, as shown in FIG. 2A, into a special insert (30*a*), which will be called a flow-conveyor, located in this area. This device can be produced using different materials and different technologies. For instance using a micro-porous material such as ethylene-vinyl-acetate (EVA), or spongy rubber or latex, these materials being formed with open cells which, for this reason, allow a good air circulation. It is formed as a flat sheet and its shape may be the whole shape of the plantar of the foot or only the front part of the plantar. For better results this flat sheet is contained in a plastic blister which has the surface in contact with the foot and formed with a plurality of holes. Another possibility uses the same materials as above but with a surface composed by reactive elements, as shown in FIG. 4A. In this case the system will have a better conveyance of air flow, also using only a tube (17 or 18). This material will have a very sharp base (31) and the surface exposed to the plantar of the foot is not a flat sheet but it is formed by a plurality of semispheres (32) or truncated cones (33), which is covered by a sharp layer of leather or by a breathable cover, such as non-woven fabric, being the surface in direct contact with the foot. This complex generates, when compressed, a movement of air (Fi) internally of the whole flow conveyor.

Another possibility uses a very common material al ready on the market, known by the commercial name "pluriball", produced with two coupled films of polyethylene, one being flat and the other formed by a plurality of semispheres which are full of air. This material is generally used for packaging and obviously its cost is very low. Obviously this material is not breathable but it will be covered, on the side in contact with the foot, by a sharp layer (37) of leather or breathable non-woven fabric. In this case the foot will be in contact with this breathable layer which will have underneath a plurality of reactive elements, the semispheres. The pressure given by the foot on the breathable layer moves the volume of air contained between the semispheres (Fi). The coupling of this "pluriball" with the upper layer may be accomplished using a special glue, which is the only way to couple this material with leather. In the case of non-woven fabric a thermic treatment may be used.

Another way for obtaining a very good result for the suction of air is to couple two layers of this material, "pluriball", putting the simispheres in contact between them and to solder the external edges of the two layers together and to make some holes on the surface in contact with the foot. In this case the flow conveyor is like a wide blister with a plurality of reactive element inside, the semispheres, which react under foot pressure to generate the needed movement of air sucked by the holes of the external surface.

Figure 4C:
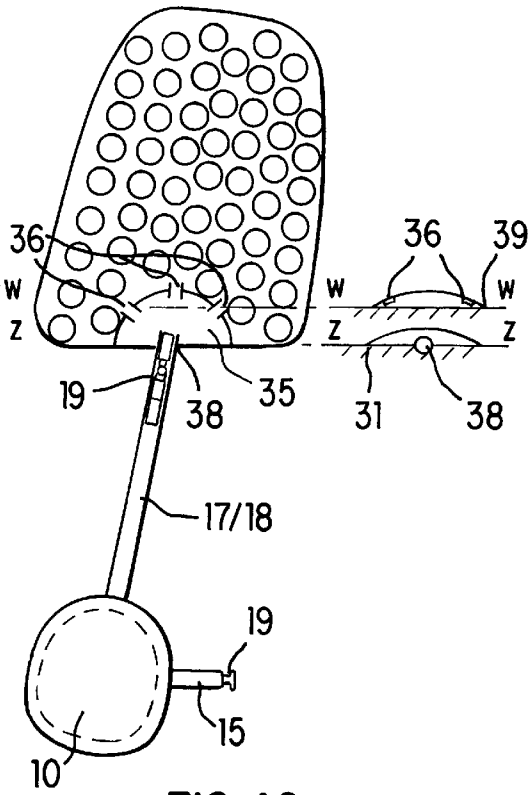
Figure 4A:
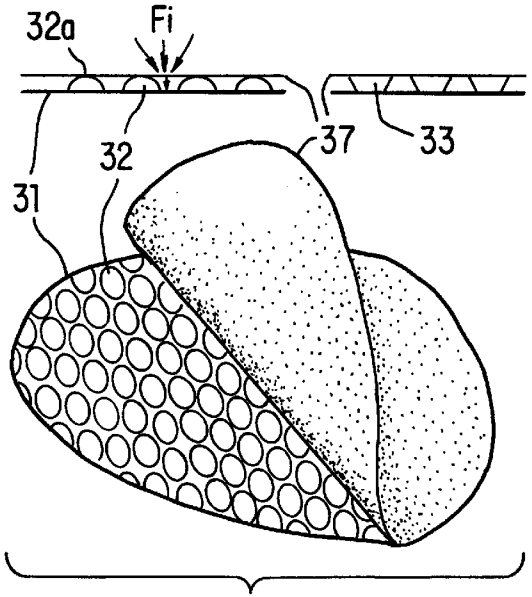
Figure 4D:
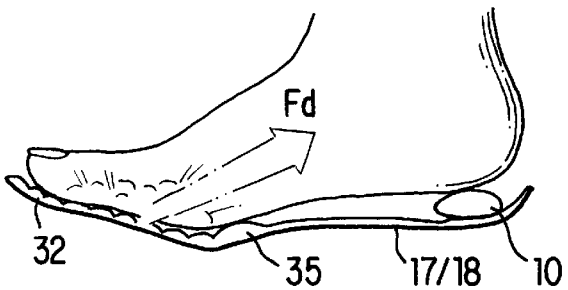

For the best results of the system, and to produce more expensive soles, the flow conveyor will have a plastic tank (35) as shown in FIG. 4C. Essentially it is a bladder, pre-formed with a plurality of holes (36) on the front part, and a hole (38) for joining to the valve (19) in the rear part. It is fixed to the flow conveyor by soldering its edges (39) to the sheet (31). Its function is to give more sucking force to the air circulation around the entire flow conveyor and to direct it toward the tubes (17 or 18) and to the pump which, with its natural force, will discharge the air outside (Fd) through valve (19) as shown in FIG. 4D.

This flow conveyor when compressed generates a movement of air which will be sucked directly by the tube (17 or 18) or by one or more arms (34) derived by the same tube, as shown in FIG. 4B. This tube, and eventually these arms, for a better result will be produced with a plurality of holes (34*a*), in order to suck more quantity of air to more points of the conveyor.

A very important factor for better operation of this system is the closing of the external valves (19). As indicated above, sometimes the wearer of this kind of shoe prefers to exclude the flow of air. For this purpose a special cap is provided for closing the cap (23) of the valve. This cap is produced by injection moulding, using thermoplastic resins and, as shown in FIG. 3, is formed with the following parts. A little sheet (41) whose inner surface is glued to the edge of the outer sole (47), on the inner part it has two or more pins (44) which enter the hollowed parts (46) of the sole. A pin (43) is not glued to the sole but in contrast with it in the point (45). A pin (42) enters the hole (22*b*) of the cap (23) and this pin is the real closing element. In operation the user pushes or pulls with a finger, which enters the hollowed part (48) of the outer sole, the free part (41) of the sheet (40) in order to close or to open the valve.

Figure 6C:
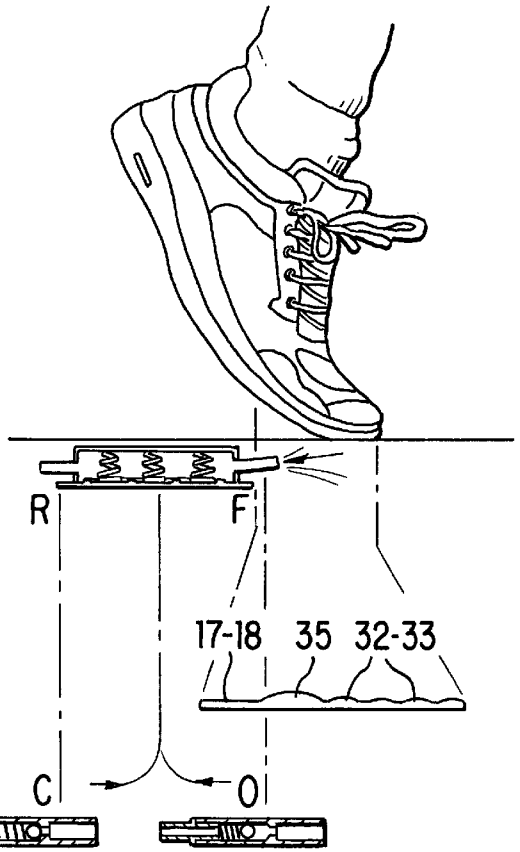
FIGS. 6A–C show the three phases of a step wherein the present system is used.
Figure 6B:
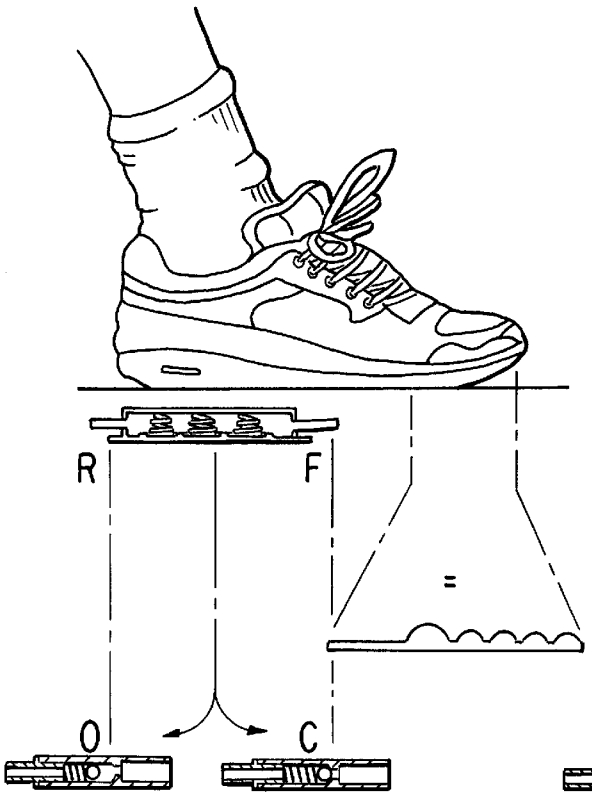
Figure 6A:
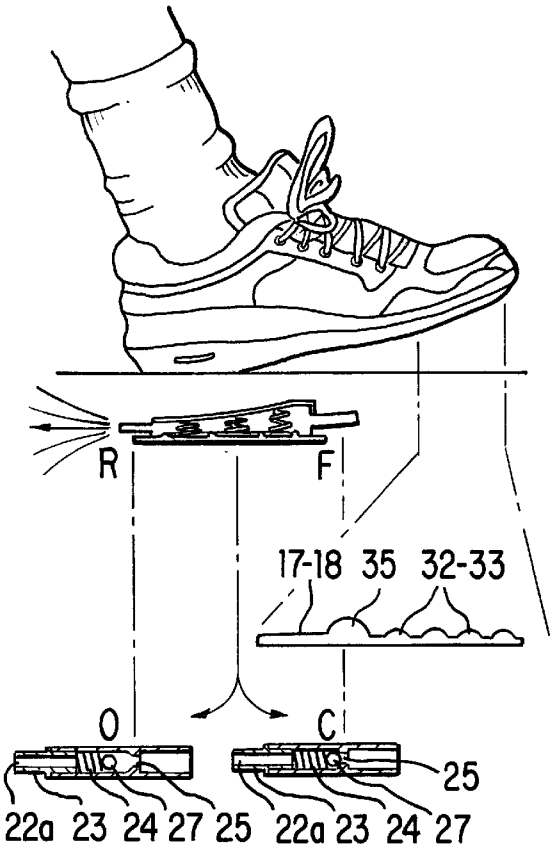

In FIG. 6 the dynamics of the system is shown, referring, as said, to the discharge of air outside the sole. The three phases of a step are: A—the impact phase, B—the rolling phase, and C—the push-off phase. In the impact phase the heel, touching the ground, compresses the rear part of the pump, which, in this drawing is the one with special reactive elements (60) inside. The pump without special reactive elements inside works in the same way. In this instant a large volume of air contained in the pump will be discharged outside because the sphere (27) of the valve (19) inserted in the rear part (R), being pushed by the same air, leaves open the hole (25) from where the air flows. This sphere can not close the hole (22*a*) of the cap (23) because the biasing action of spring (24) leaves this hole (22*a*) open for the exit of air. Therefore, in this case, the valve is opened (0). At the opposite side of the pump, the front part (F) directed toward the sole, the air flow passing through the hole (22*a*) of front valve (19) presses the sphere (27) which closes the inner hole (25) of the valve and does not permit any exit of air and the spring (24) maintains the sphere in the proper position. Therefore, in this case, the valve is closed (C). In the planter area where the flow conveyor (32*a*), joined to the tube (17–18) which is connected to the valve (F), is located it is obviously uncompressed and full of air.

In the rolling phase the whole foot touches the ground, therefore even the front part of the pump is compressed and all the air contained in the pump is discharged outside. In this phase, the valves and the flow conveyor are in the same position as in the impact phase (A).

In the push-off phase, the planter of the foot leaves the ground and, making this movement, compresses the retractile elements (32–33) of the flow conveyor and the air contained between them moves through the tank (35) and the tubes (17–18) inflating the pump. In this phase, for the opposite circumstances of the phase (A) the valve located in the front side (F) is opened (0), the valve located in the rear side (R) is closed (C) and the flow conveyor is obviously totally empty of air.

What is claimed is:

1. A forced ventilation system disposed inside a shoe sole, said system comprising a) a pump disposed in the heel of the shoe sole in the form of a rectangular plastic box having an interior and including a cover (50*b*) having an edge (59*a*) and a lower plate (50*a*) having an edge (58*a*), said cover and lower plate being formed by injection molding of low density thermoplastic resins, said edge of said lower plate being soldered to said edge of said cover, at least one first opening (51) in said cover for communicating externally of the shoe sole via a first conduit (17), and at least one second opening (52) in said cover for communicating internally of the shoe sole at the plantar area via a second conduit (17);

b) a reactive element disposed in the interior of the plastic box comprising at least one metal spring (60*a*) having at least an upper coil and a lower coil wherein the upper coil enters a fixing pin (54*a*) formed on an inner surface of cover (50*b*) and the lower coil is fixed with a ring (55*a*) formed on an inner surface of lower plate (50*a*), the fixing of the lower coil of spring (60*a*) with ring (55*a*) is accomplished by creating a joule effect in the lower coil of the spring using a transformer to step down a common voltage to a low voltage and connecting the positive and negative poles of the transformer to two thin copper plates contacting the lower spring coil so that a short circuit is established and the lower coil becomes incandescent and amalgamated with ring (55*a*);

c) a flow conveyor disposed in the shoe sole plantar area communicating with said second opening in said pump cover, said flow conveyor comprising a flat sheet of micro porous material shaped to cover the plantar area and a plastic blister containing said flat sheet of micro porous material and having openings therein on a side thereof in contact with a user's foot;

d) a first one-way pneumatic valve (19) associated with said first opening (51) for directing air from said pump externally of the shoe sole;

e) a second one-way pneumatic valve (19) associated with said opening (52) for directing air into said pump from the shoe sole plantar area; and f) a removable closing element for closing said at least one second opening (52) in said pump cover so that the pump is unable to communicate externally of the shoe sole.

2. The forced ventilation system as defined in claim 1, wherein said first one-way pneumatic valve comprises a tube (21) having an opening (22*a*) therethrough with a smaller inner hole (25) therein, a closure element in the form of a piston (26) or a ball (27) disposed away from said pump relative to said hole (25), a spring (24) for biasing said piston or ball against said hole (25), and a cap (23) having a through opening (22*b*) received in opening (22*a*) of tube (21) to hold said spring (24) against said piston or ball, and wherein said second one-way pneumatic valve comprises a tube (21) having an opening (22*a*) therethrough with a smaller inner hole (25) therein, a closure element in the form of a piston (26) or a ball (27) disposed toward said pump relative to said hole (25), a spring (24) for biasing said piston or ball against said hole (25), and a cap (23) having a through opening (22*b*) received in opening (22*a*) of tube (21) to hold said spring (24) against said piston or ball.

3. The forced ventilation system as defined in claim 2, wherein said first one-way pneumatic valve (19) is disposed in said first conduit (17) adjacent an edge of the outer sole (47), and said removable closing element comprises a sheet (41) glued to the edge of the outer sole (47), said sheet (41) having at least one first pin (44) received in a hollowed part (46) of the sole, a second pin (43) not glued to the sole but in contrast with point (45), and a third pin (42) received in opening (22*b*) of cap (23).

4. The forced ventilation system as defined in claim 1, wherein said flow conveyor comprises a base (31) having a plurality of air filled semispheres or truncated cones facing the foot of the wearer covered by a breathable cover.

5. The forced ventilation system as defined in claim 4, wherein the flow conveyor includes a plastic blister in the rear part thereof having an opening (38) communicating with second opening (52) in the pump cover via second conduit (17) and second one-way pneumatic valve (19) and a plurality of holes (36) communicating with the flow conveyor, said plastic blister being soldered to base (31).

6. The forced ventilation system as defined in claim 1, wherein said flow conveyor comprises a lower layer of flat plastic film and an upper layer of plastic film formed by a plurality air filled semispheres coupled with said lower layer by means of glue or thermic treatment, said two layers being covered by a breathable layer.

7. The forced ventilation system as defined in claim 1, wherein said second one-way pneumatic valve (19) is disposed in said second conduit (17), and a part of said second conduit (17) which enters said flow conveyor includes a plurality of holes (34*a*) for better suction of air in said flow conveyor.

* * * * *